United States Patent [19]

Hay

[11] 3,969,231

[45] *July 13, 1976

[54] FLAME-RETARDANT SOFTENING AGENTS

[75] Inventor: Peter M. Hay, Summit, N.J.

[73] Assignee: Sandoz, Inc., E. Hanover, N.J.

[ * ] Notice: The portion of the term of this patent subsequent to May 11, 1993, has been disclaimed.

[22] Filed: Sept. 16, 1974

[21] Appl. No.: 506,233

[52] U.S. Cl. ..... 252/8.8; 252/8.1; 260/403; 428/245; 428/265; 428/267

[51] Int. Cl.[2] ..... D06M 13/26

[58] Field of Search ..... 252/8.8, 8.1; 117/136, 117/139.5 F; 260/45.9 NP, DIG. 24

[56] References Cited

UNITED STATES PATENTS

| | | | |
|---|---|---|---|
| 2,340,881 | 2/1944 | Kelley et al. | 252/8.8 |
| 2,541,101 | 2/1951 | Robinette et al. | 252/8.8 |
| 2,662,834 | 12/1953 | Paist et al. | 117/136 |
| 3,046,297 | 7/1962 | Overbeek et al. | 252/8.1 |
| 3,074,815 | 1/1963 | Lee et al. | 252/8.8 |
| 3,200,106 | 8/1965 | Dickson et al. | 252/8.8 |
| 3,660,582 | 5/1972 | DiPietro et al | 260/45.9 NP |
| 3,719,547 | 3/1973 | Martin et al. | 161/191 |
| 3,719,597 | 3/1973 | Wegerhoff et al. | 252/8.8 |

FOREIGN PATENTS OR APPLICATIONS

| | | |
|---|---|---|
| 1,487,570 | 7/1967 | France |
| 1,534,719 | 8/1968 | France |
| 657,419 | 9/1951 | United Kingdom |

OTHER PUBLICATIONS

Rayner, et al., Chemical Abstracts, vol. 64: 16,133b (1966).

Mayer, et al., Chemical Abstracts, vol. 76: 60,868t (1972).

Barton, et al., Chemical Abstracts, vol. 76: 128,618u (1972).

*Primary Examiner*—Murray Tillman
*Assistant Examiner*—W. C. Danison, Jr.
*Attorney, Agent, or Firm*—Gerald D. Sharkin; Richard E. Vila; Joseph J. Borovian

[57] ABSTRACT

Softening agents, especially useful for treatment of synthetic fiber shag carpeting, to impart softening and anti-soiling properties and which do not increase the inherent flammability of the carpeting are provided by reacting a fatty acid or fatty ester amide-amine with tris-(2,3-dibromopropyl)-phosphate.

23 Claims, No Drawings

FLAME-RETARDANT SOFTENING AGENTS

Substantial amounts of softening agents are consumed in the commercial manufacture and finishing of a host of textile products including those of synthetic and natural fibers, including carpet materials, such as polyester shag carpeting. Certain of these softening agents, such as those referred to as fatty acid amide-amines, also impart anti-soiling properties but have the disadvantage of undesirably increasing the flammability of the fabric. Additionally, many softening agents, including the fatty acid amide-amines, also suffer from the disadvantage of being poorly water-dispersible, and can only be rendered water-dispersible by the addition of substantial amounts of other reagents, e.g., acetic acid, which in many cases serve no other useful purpose in the ultimate commercial processes and often further deleteriously affect the flammability. Thus, there is a real need in the art for water-dispersible, flame-retardant softening agents.

Accordingly, an object of this invention is to provide novel, flame-retardant, softening agents. Another object of this invention is to provide novel, flame-retardant, softening agents exhibiting antisoiling properties.

Still another object of this invention is to provide novel, flame-retardant, softening agents exhibiting good water dispersibility.

Yet, still another object of this invention is to provide novel, flame-retardant water-dispersible fatty acid or fatty ester amide-amine derivatives exhibiting softening and anti-soiling properties.

In accordance with the present invention, water-dispersible, flame-retardant softening agents are provided by the product obtained on reacting A) the compound of formula I:

$$(BrCH_2CHBrCH_2O)_3PO \qquad \text{I}$$

with B) the reaction product of i) a fatty acid or an ester derivative thereof, wherein said fatty acid or ester derivative thereof is selected from the group consisting of:

a. a saturated fatty acid of 12 to 22 carbon atoms, or a mixture thereof, b. a lower alkyl ($C_1$–$C_4$) or glycerol ester of a saturated fatty acid of 12 to 22 carbon atoms, or a mixture thereof, c. a mixture of at least one saturated fatty acid of 12 to 22 carbon atoms with one or more monounsaturated fatty acids of 14 to 22 carbon atoms, said mixture containing not more than 75% by weight of monounsaturated fatty acids, d. a mixture of at least one lower alkyl ($C_1$–$C_4$) or glycerol ester of a saturated fatty acid of 12 to 22 carbon atoms with one or more lower alkyl ($C_1$–$C_4$) or glycerol esters of monounsaturated fatty acids of 14 to 22 carbon atoms, said mixture containing not more than 75% by weight of esters of monounsaturated fatty acids, and e. mixtures thereof, and ii. a polyamine or mixture of polyamines of the formula II:

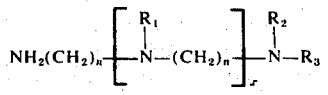

II

-continued wherein $R_1$, $R_2$ and $R_3$ are independently hydrogen or lower alkyl of 1 to 3 carbon atoms, $n$ is an integer of 2 or 3, and $x$ is an integer of 0 to 3, the mol ratio of the fatty acid or ester derivative thereof expressed as the fatty acyl radical to the compound II being in the range of 1:1 to 3:1, subject to the proviso that the reaction product of i) and ii) is substantially free of unreacted polyamine, and the weight ratio of reactant B to reactant A being in the range of from 10:1 to 0.5:1.

The reaction of the compound I (reactant A) with the reaction product of the fatty acid or ester derivative thereof and compound II (reactant B) may be carried out over a fairly wide range of temperatures of from about 30° to 150°C., preferably 40° to 130°C. The reaction may be carried out in the presence or absence of added solvents and is preferably carried out in the absence of added solvents e.g., in the melt or in aqueous suspension, at temperatures more preferably in the range of from 50° to 120°C., desirably between 60°C. and 100°C. When carried out in the presence of a solvent, the solvent may be any of several conventional organic types providing an inert medium. Examples of such solvents include toluene, perchlorethylene, acetone and the like. The reaction is carried out with the application of shearing forces suitable to intimately admix the reactants, e.g., in a mixing vessel. The reaction time is not particularly important and will vary depending upon a number of factors such as the presence or absence of a solvent, the weight ratio of reactant B to reactant A, and the mol ratio of the fatty acid or ester derivative thereof, expressed as the fatty acyl radical to compound II, employed in preparing reactant B. In general, the reaction may be substantially completed in as little as 2 minutes or may be extended until a period of 12 or more hours has elapsed. In practice, reaction times are usually in the range of from about 4 minutes to 2 hours, more usually in the range of from about 5 minutes to 60 minutes. Under the more preferred conditions for forming the more preferred products of the invention. i.e., in absence of added solvent, the reaction time usually varies between 8 to 25 minutes. In general, it is desirable to regulate time and temperature to form the desired product without causing any substantial discoloration of the product. The reaction may be effected above or below normal atmospheric pressure, but is conveniently and preferably effected at about normal atmospheric pressure. The products prepared in the absence of a solvent may be recovered directly without essentially any further treatment while the added solvents may, if desired, be readily removed by conventional procedures.

The reactant B employed in producing the products of this invention are a class of products which are generally well known in the art and thus their preparation by conventional procedures is similarly well known. The time and temperature of the reaction depends upon the particular long chain fatty acid or ester derivative thereof and polyamine involved. In general, such reactions are carried out at temperatures in the range of from 100° to 220°C., preferably 120° to 200°C., and more preferably between 140° and 200°C. The reaction is usually carried out substantially in the absence of added solvents; however, the reaction may be facilitated by the use of azeotropic materials which help to drive out of the reaction system, the water or alcohol formed in the reaction. These azeotropic materials may be any organic substance capable of forming a suitable azeotrope with water. Preferred azeotropes include benzene, xylene, and toluene. While the reacton may be conducted at atmospheric pressure, it is generally desirable to carry out the reaction at sub-atmospheric pressure, at least during those periods when the water or alcohol produced by the condensation is being removed from the reaction mixture. Air and other oxygen-containing gases are generally substantially excluded from the reaction area to avoid discoloration of the product and the use of reduced pressures constitutes a convenient procedure whereby the removal of water or alcohol and the exclusion of air may be facilitated. Pressures ranging from about 0.7 atmospheres down to about 0.006 atmospheres are thus typically employed. Reaction time may vary fairly widely depending upon the particular starting materials, the ratio in which they are employed and the particular product which is desired. The reaction time will usually be in the range of from 3 to 36 hours, preferably from 4 to 20 hours, and more preferably between 5 and 12 hours. In general, the reaction is carried out at least for a time sufficient to produce the amount of water or alcohol theoretically indicated by the fatty acid or fatty ester amide-forming condensation reaction, and thereafter up to 36 hours, preferably no more than 20 hours, as may be desired. The typically more preferred reacton commences at about 140°C. to 150°C., under moderately reduced pressures at which time the reactants, under vigorous agitation, are slowly heated to 170°C. while the pressure is decreased to remove water or alcohol and the temperature maintained at between 170° and 190°C. for at least 3 hours, the total reaction time being between 5 and 12 hours.

Some of the more readily available saturated and monounsaturated fatty acids for preparing reactant B are lauric, myristic, palmitic, stearic, behenic, oleic, ricinoleic, linoleic, linolenic, and mixtures thereof. In addition, fatty acids or mixtures of such acids that occur in various fats and oils, such as coconut oil, tallow, hydrogenated tallow, castor oil, hydrogenated castor oil, etc. may be used. However, the preferred embodiment of the invention involves the use of fatty acids containing little or no monounsaturated acids, and more especially, the saturated acids of 16 to 18 carbon atoms and mixtures thereof.

Among the more readily available lower alkyl esters or glycerol esters of saturated and monounsaturated fatty acids are methyl laurate, ethyl myristate, methyl stearate, ethyl oleate, glycerol tristearate, glycerol monooleate, and fatty triglycerides such as hydrogenated tallow glyceride, hydrogenated marine triglyceride, hydrogenated animal fat, hydrogenated vegetable oil, hydrogenated sperm oil and hydrogenated castor oil. However, the preferred embodiment of the invention involves the use of fatty triglycerides, more preferably, hydrogenated tallow glyceride.

The polyamine employed in preparing reactant B may be any alkylene polyamine having the abpve general formula II. The preferred starting alkylene polyamine may be chosen from among diethylene triamine, triethylene tetramine, and tetraethylene pentamine. Of these polyamines, the most preferred is diethylene triamine, due mainly to cost and availability.

The preferred fatty acid or ester derivative amineamides for use in the present invention are those which are obtained in accordance with one or more of the following specific conditions: 1) the use of commercial stearic acid as the fatty acid component; 2) the use of a fatty triglyceride as the fatty ester component; 3) the use of a polyamine of the formula II above where $R_2$ and $R_3$ are hydrogen; 4) the reaction of the fatty acid and polyamine in a mol ratio of 1.5:1 to 2.2:1; and 5) the reaction of the fatty ester and polyamine in a mol ratio of 2.0:1 to 2.8:1. The more preferred fatty acid amine-amides are those obtained by the reaction of commercial stearic acid containing between 25% and 70% by weight of stearic acid with diethylene triamine in a mol ratio of 1.5:1 to 2.2:1 at temperatures regulated within the range of 140° to 200°C. for a time of from 5 to 12 hours at sub-atmospheric pressure in a substantially oxygen-free atmosphere. The more preferred fatty acid ester amine-amides are those obtained by the reaction of hydrogenated tallow glyceride with diethylene triamine in a mol ratio of 2.0:1 to 2.8:1 at temperatures regulated within the range of 140° to 200°C. for a time of from 4 to 12 hours at sub-atmospheric pressure in a substantially oxygen-free atmosphere. In general, the products produced on reacting the fatty acid or ester derivative thereof with a compound of formula II, or on reaction of mixtures of said compounds, may be used as such in preparing the softening agents of the invention without separation of any of the products or by-products of the reaction (with the general exception of the water or alcohol produced) so long as the reaction is carried out as generally specified herein and so long as all or substantially all of the polyamine has been reacted.

Since the exact nature of the reactant B is not precisely known, it will be evident that the products provided by the present invention are even more difficult to precisely determine. The products of the present invention are believed to be at least predominantly salts formed on reaction of the secondary and/or tertiary nitrogen atoms in the fatty acid or fatty ester derivatives with the bromoalkyl moieties in the compound I. The conclusion that the products are salts is supported by the chemical nature of the starting materials, the apparent lack of by-product formation and the improved water dispersibility of the products. However, the various reaction possibilities and the apparently complex nature of the products leave the precise nature of the products of the invention unknown. The preferred softening agents of the present invention, in addition to being preferably derived from the preferred and more preferred fatty acid or fatty ester amine-amide derivatives above-indicated are generally those which are obtained by the reaction of the fatty acid or fatty ester amine-amide derivative reacton product (dry weight) and the compound of the formula I in a weight ratio of from 3:1 to 1:1, more preferably from 2:1 to 1:1. While a weight ratio of 10:1 generally produces a softening agent which can be dispersed in water and which has reduced flammability, the weight ratios not in excess of 3:1, more preferably in the range of 2:1 to 1:1, are usually required in order to impart self-extinguishing properties to the product. Weight ratios which are less than 0.5:1 are generally undesirable as tending increasingly to substantially depreciate the properties which are desired in a softening agent. The particularly preferred products of the present invention are obtained by reacting the compound of the formula I (reactant A) with a fatty acid amine-amide reaction product (reactant B) produced by reacting an approximately equal weight mixture of palmitic and stearic acid with diethylene triamine in a mol ratio of 2:1 at a temperature regulated within the range of 160° to 200°C. for from 5 to 12 hours at sub-atmospheric pessure in a substantially oxygen-free atmosphere, the reactant B and the reactant A being reacted at a weight ratio in the range of from 3:1 to 1:1, more preferably from 2:1 to 1:1, at a temperature regulated within the range of from 60° to 100°C. for a time of from 5 to 60 minutes, more preferably from 8 to 25 minutes. The softening agents provided by the invention are typically waxy solids which can be broken up and readily dispersed with mixing in hot water (ca 70°C.) The dispersions are generally slightly acidic, e.g., have a pH in the range of 3.5 to 6.5, more usually 4.0 to 6.0. As a practical matter, the water dispersibility and the stability of the dispersions are improved by the addition of minor quantities of water-soluble, organic surfactants which, in general, may be any of several well known types. In general, such surfactants may be combined with the softening agents of the invention in amounts which are between 1.0% and 20% based on the weight of the softening agent, more usually in an amount between 5 and 15% based on the weight of the softening agent. The preferred surfactants are the nonionic surfactants and more especially those derived from condensing an aliphatic alcohol having from 8 to 22 carbon atoms with an alkylene oxide of 2 to 4 carbon atoms, such as that obtained commercially under the trademark designation EKALINE G FLAKES (Sandoz-Wander, Inc.) which is a ethoxylated linear alcohol prepared by condensing a $C_{16}$ to $C_{18}$ alcohol or mixture thereof with 15 to 35 mols of ethylene oxide. The particular surfactant to be selected may depend upon a number of factors including the particular softening agent under consideration and the influence of the surfactant on various properties of the resulting dispersions. The surfactants may be combined by conventional procedures with the softening agent of the invention after preparation of the softening agent. However, since many of the surfactants are more or less solid materials, it has been found convenient and preferred to incorporate the surfactant directly into the mixture in which the softening agents of the invention are produced, such surfactants being incorporated into such mixtures in an amount of from 1.0% to 20%, preferably 5% to 15%, by total weight of the reactant A and reactant B in said mixture. The more preferred surfactants are, therefore, those which are relatively stable and inert under the conditions in which the softening agents of the invention are produced.

The products of the invention can be adapted for storage and sale in different forms. A solid form can be readily produced by the reaction of reactant A and reactant B, preferably in the presence of a surfactant. On the other hand, liquid forms constituting aqueous dispersions containing typicaly 3.0 to 40%, more usually 5.0 to 30% by weight of the reaction product of the invention may also be made available. The fluidity of such dispersions containing the larger amounts of the reaction product of the invention may be readily adjusted to the desired level by the addition of any of several known agents suitable for this purpose and selected primarily for efficiency in relation to the particular product and compatability in the ultimate purpose for which it will be employed. For example, small quantities of isopropanol constituting approximately 0.5 to 5.0% by weight based on the total weight of the reaction product and water in the dispersion may be employed to produce products for use by those wishing to apply softening agents to dyed carpet materials. While the dispersions may be readily prepared from the reaction products of the invention, it has been found convenient and preferred to produce such dispersions during the formation of the reaction product by forming the reaction products of the invention in an aqueous suspension medium which may also contain viscosity stabilizing agents, such as isopropanol, methanol, ethanol, acetone, ethylene glycol and the like, and also, if desired, the surfactant which may be desired in the final product. When prepared in this manner, the reaction product becomes dispersed in the water as it is formed and the resulting dispersion may be recovered, stored and sold substantially without further processing.

The reaction products of the present invention may be employed as softening agents for a variety of vegetable, animal or synthetic fibres or a mixture thereof, for instance wool, cotton, jute, silk, regenerated cellulose, acetate rayon, or a polyamide, polyester, polyolefin, polyvinylidene chloride or polyacrylic fiber, or a mixture of a vegetable and/or synthetic fiber with wool. The fiber assembly may be, for instance, a pile yarn or fabric made from such fibers or fiber mixtures, for example, rugs, tufted carpets, other carpeting materials, upholstery, curtains and "flock", bonded or printed materials. The reaction products may be applied using conventional techniques employed in the application of known softening agents; these products also provide good anti-soiling properties.

The following examples illustrate the preferred procedure to be followed in accordance with this invention; however, it should be understood that the examples are all illustrative only and not exclusive.

EXAMPLE 1

A charge of 268 parts of triple press stearic acid and 52 parts of diethylene triamine (mol ratio of fatty acyl radical to amine of 2:1) is heated under reduced pressure with stirring for 12 hours at a temperature which is slowly increased from 110° to 190°C. and which for a period of 8 hours is between 170° and 190°C. Pressure is slowly decreased during the reaction from an initial pressure of about 0.7 atmospheres to a final pressure of about 0.02 atmospheres. The resulting cooled waxy product in the amount of 50 parts is charged to a mixing tank alone with 50 parts of tris(2,3-dibromopropyl)phosphate and the resulting mass is stirred at 70°–75°C. for 15 minutes. The resulting clear melt is cast into trays and cooled to obtain a waxy solid which can be readily broken up. This product is readily dispersible in hot water (ca 70°C.) and does not burn in a Candle test in which a lighted match is repeatedly applied to the wick of a small candle (3 cm. diameter) made from the melted reaction product and a strand of asbestos yarn saturated with the melted softener, the results being evaluated both with respect to the wick and the candle body in this test.

EXAMPLE 2

A charge of 45 parts of a triple press stearic acid amine-amide as prepared in Example 1 and 10 parts of an ethoxylated linear alcohol obtainable under the trademark EKALINE G FLAKES is melted in a mixing tank at 70°C. and there is then added 45 parts of tris-(2,3-dibromopropyl)phosphate. The resulting mass is stirred at 70°–80°C. for 15 minutes and the resulting clear melt is cast into trays and cooled to obtain a waxy solid which can be readily broken up. This product is readily dispersible in hot waer and does not burn (neither wick or candle body) in the Candle test.

When applied to white, loop-pile polyester carpet, this softening agent imparts excellent anti-soiling properties, as evidenced by employing AATCC Test Method 122–1970 and measuring the carpet reflectance on the Hunterlab D-25 meter using the "whiteness" scale.

EXAMPLE 3

A charge of 284 parts of stearic acid and 103 parts of diethylene triamine (mol ratio of fatty acyl radical to amine of 1:1) is heated under reduced pressue with stirring for 12.5 hours at a temperature which is slowly increased from 110° to 200°C. and which for a period of 10.5 hours is between 170° and 190°C. Pressure is slowly decreased during the reaction from an initial pressure of about 0.7 atmospheres to a final pressure of about 0.04 atmospheres. The resulting cooled waxy product in the amount of 60 parts is charged to a mixing tank along with 30 parts of tris(2,3-dibromopropyl)phosphate and the resulting mass is stirred at 70°–75°C. for 15 minutes. The resulting clear melt is cast into trays and cooled to obtain a waxy solid which can be readily broken up. This product is readily dispersible in hot water and does not burn (neither wick nor candle body) in the Candle test.

EXAMPLE 4

A charge of 500 parts of hydrogenated tallow glyceride and 60 parts of diethylene triamine (mol ratio of fatty acyl radical to amine of 2.8:1) is heated under reduced pressure with stirring for 8 hours at a temperature which is slowly increased from 100° to 190°C. and which for a period of 6 hours is between 160° and 185°C. Pressure is slowly decreased during the reaction from an initial pressure of about 0.5 atmospheres to a final pressure of about 0.04 atmospheres. The resulting cooled waxy product in the amount of 60 parts is charged to a mixing tank along with 30 parts of tris-(2,3-dibromopropyl)phosphate and the resulting mass is stirred at 70°–75°C. for 15 minutes. The resulting clear melt is cast into trays and cooled to obtain a waxy solid which can be readily broken up. This product is readily dispersible in hot water and does not burn (neither wick nor candle body) in the Candle test.

EXAMPLE 5

A charge of 75 parts of a triple press stearic acid amine-amide as prepared in Example 1 and 25 parts of tris(2,3-dibromopropyl)phosphate is reacted as in Example 1. The product is dispersible in hot water and the wick burns only briefly while the candle body does not burn in the Candle test.

EXAMPLE 6

A charge of 80 parts of a triple press stearic acid amine-amide as prepared in Example 1 and 20 parts of tris(2,3-dibromopropyl)phosphate is reacted as in Example 1. The product is dispersible in hot water and the wick burns while the candle body burns only briefly in the Candle test.

EXAMPLE 7

A charge of 90 parts of a triple press stearic acid amine-amide as prepared in Example 1 and 10 parts of tris(2,3-dibromopropyl)phosphate is reacted as in Example 1. The product is dispersible in hot water and the wick burns while the candle body burns only briefly in the Candle test.

EXAMPLE 8

A charge of 78.9 parts of water, 1.1 parts of 91% isopropanol and 2.0 parts of EKALINE G FLAKES is mixed in a mixing tank at 50°C. until a clear solution is obtained. There is then added 9 parts of tris-(2,3-dibromopropyl)phosphate and the resulting mass stirred for 15 minutes at 50°C. There is then added 9 parts of the triple press stearic acid amine-amide as prepared in Example 1 and the resulting mass is stirred at 70°–80°C. for 15 minutes to obtain an aqueous dispersion which is cooled to 60°C. and led into storage drums.

When applied to polyester shag carpeting of relatively light weight (41 ounces per square yard), which has been previously dyed, this dispersion imparts excellent softening properties with essentially the same inherent flame-resistant properties of the products of Examples 1 and 2, as evidenced by subjecting the carpet to the official U.S. Government "pill test".

EXAMPLE 9

A charge of 233 parts of palmitic acid and 47 parts of diethylene triamine (mol ratio of fatty acyl radical to amine of 2:1) is heated under reduced pressure with stirring for 12 hours at a temperature which is slowly increased from 110° to 210°C. and which for a period of 10 hours is within the range of about 150° to 200°c. Pressure is slowly decreased during the reaction from an initial pressure of about 0.7 atmospheres to a final pressure of about 0.02 atmospheres. The resulting cooled waxy product in the amount of 50 parts is charged to a mixing tank along with 14 parts of EKALINE G FLAKES and the resulting mass melted at a temperature of 70°C. There is then added 50 parts of tris-(2,3-dibromopropyl)phosphate and the resulting mass is stirred at 70°–75°C. for 14 minutes. The resulting melt is cast into trays and cooled to obtain a waxy solid which is readily dispersed in hot water and which does not burn (neither wick nor candle) in the Candle test.

As many different embodiments of this invention may be made without departing from the spirit and scope thereof, it is to be understood that the invention is not limited to the specific embodiments disclosed herein.

What is claimed is:

1. A textile softening agent produced by reacting A) the phosphate compound of the formula:

$$(BrCH_2CHBrCH_2O)_3PO$$

with B) the reaction product of i) a fatty acid or an ester derivative thereof, wherein said fatty acid or ester derivative thereof is selected from the group consisting of:

a. a saturated fatty acid of 12 to 22 carbon atoms, or a mixture thereof, b. a lower alkyl ($C_1$–$C_4$) or glycerol ester of a saturated fatty acid of 12 to 22 cabon atoms, or a mixture thereof, c. a mixture of at least one saturated fatty acid of 12 to 22 carbon atoms with one or more monounsaturated fatty acids of 14 to 22 carbon atoms, said mixture containing not more than 75% by weight of monounsaturated fatty acids, d. a mixture of at least one lower alkyl ($C_1$–$C_4$) or glycerol ester of a saturated fatty acid of 12 to 22 carbon atoms with one or more lower alkyl ($C_1$–$C_4$) or glycerol esters of monounsaturated fatty acids of 14 to 22 carbon atoms, said mixture containing not more than 75% by weight of esters of monounsaturated fatty acids, and e. mixtures thereof, and ii) a polyamine or mixture of polyamines of the formula II:

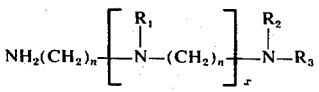

wherein $R_1$, $R_2$ and $R_3$ are independently hydrogen or lower alkyl of 1 to 3 carbon atoms,

*n* is an integer of 2 or 3, and

*x* is an integer of 0 to 3, the mol ratio of the fatty acid or ester derivative thereof expressed as the fatty acyl radical to the polyamine being in the range of 1:1 to 3:1, subject to the proviso that the reaction product of i) and ii) is substantially free of unreacted polyamine, said reaction product produced by the reaction of said fatty acid or ester derivative thereof and said polyamine at a temperature between 100° and 220°C. for a time sufficient to produce substantially the entire amount of water or alcohol theoretically indicated by the fatty acid or fatty ester/amide-forming condensation reaction but not in excess of 36 hours, said reaction product and said phosphate compound being reacted in a weight ratio of from 10:1 to 0.5:1 at a temperature between 30° and 150°C. for a period of time between 2 minutes and 12 hours.

2. A softening agent in accordance with claim 1 in which said reaction product and said phosphate compound are reacted in a weight ratio of from 3:1 to 1:1 at a temperature of from 40° to 130°C.

3. A softening agent in accordance with claim 1 in which said reaction product and said phosphate compound are reacted in a weight ratio of from 2:1 to 1:1 at a temperature of from 50° to 120°C.

4. A softening agent in accordance with claim 1 in which said reaction product and said phosphate compound are reacted in a weight ratio of from 2:1 to 1:1 at a temperature of from 60° to 100°C. for a period of time between 5 and 60 minutes in the absence of added solvent.

5. A softening agent in accordance with claim 1 wherein said reaction product is produced by the reaction of a fatty acid component and said polyamine in a mol ratio of 1.5:1 to 2.2:1 at a temperature between 120° and 200°C. for a period of time between 4 and 20 hours, at sub-atmospheric pressure.

6. A softening agent in accordance with claim 1 wherein said reaction product is produced by the reaction of a fatty acid component and said polyamine in a mol ratio of 1.5:1 to 2.2:1 at a temperature between 140° and 200°C. for a period of time between 5 and 12 hours, at sub-atmospheric pressure.

7. A softening agent in accordance with claim 2 wherein said reaction product is produced by the reaction of a fatty acid component and said polyamine in a mol ratio of from 1.5:1 to 2.2:1 at a temperature between 120° and 200°C. for a period of time between 4 and 20 hours, at a pressure between 0.7 and 0.006 atmospheres.

8. A softening agent in accordance with claim 7 wherein said fatty acid component is a mixture containing saturated fatty acids of 12 to 22 carbon atoms and said polyamine is diethylene triamine.

9. A softening agent in accordance with claim 8 wherein said fatty acid component is a mixture containing palmitic and stearic acids comprising between 25% and 70% by weight of stearic acid and said polyamine is diethylene triamine.

10. A softening agent in accordance with claim 1 wherein said reaction product is produced by the reaction of a fatty ester component and said polyamine in a mol ratio of from 2.0:1 to 2.8:1 at a temperature between 120° and 200°C. for a period of time between 4 and 20 hours, at sub-atmospheric pressure.

11. A softening agent in accordance with claim 1 wherein said reaction product is produced by the reaction of a fatty ester component and said polyamine in a mol ratio of from 2.0:1 to 2.8:1 at a temperature between 140° and 200°C. for a period of time between 4 and 12 hours, at sub-atmospheric pressure.

12. A softening agent in accordance with claim 2 wherein said reaction product is produced by the reaction of a fatty ester component and said polyamine in a mol ratio of from 2.0:1 to 2.8:1 at a temperature between 120° and 200°C. for a period of time between 4 and 20 hours, at a pressure between 0.7 and 0.006 atmospheres.

13. A softening agent in accordance with claim 12 wherein said fatty ester component is a glycerol ester of a mixture of saturated fatty acids of 12 to 22 carbon atoms and said polyamine is diethylene triamine.

14. A softening agent in accordance with claim 13 wherein said fatty ester component is hydrogenated tallow glyceride and said polyamine is diethylene triamine.

15. A softening agent in accordance with claim 7 and produced by reacting the reaction product and the phosphate compound in the presence of from 1.0 to 20%, based on the weight of the softening agent, of a water-soluble, organic nonionic surfactant which is substantially inert in the reaction of said reaction product and phosphate compound.

16. A softening agent in accordance with claim 15 in which the reaction is carried out in the presence of from 5 to 15% of a water-soluble, organic nonionic surfactant.

17. A softening agent in accordance with claim 7 in aqueous dispersed form and produced by reacting the reaction product and the phosphate compound in aqueous suspension, the total weight of said reaction product and phosphate compound constituting between 3 and 40% of the total weight of said reaction product, phosphate compound and water.

18. A softening agent in accordance with claim 17 and produced by reacting the reaction product and the phosphate compound in the presence of from 1.0 to 20%, based on the weight of the softening agent, of a water-soluble, organic nonionic surfactant inert in the reaction of said reaction product and phosphate compound.

19. A softening agent in accordance with claim 12 and produced by reacting the reaction product and the phosphate compound in the presence of from 1.0 to 20%, based on the weight of the softening agent, of a water-soluble, organic nonionic surfactant which is substantially inert in the reaction of said reaction product and phosphate compound.

20. A softening agent in accordance with claim 19 in which the reaction is carried out in the presence of from 5 to 15% of a water-soluble, organic nonionic surfactant.

21. A softening agent in accordance with claim 12 in aqueous dispersed form and produced by reacting the reaction product and the phosphate compound in aqueous suspension, the total weight of said reaction product and phosphate compound constituting between 3 and 40% of the total weight of said reaction product, phosphate compound and water.

22. A softening agent in accordance with claim 21 and produced by reacting the reaction product and the phosphate compound in the presence of from 1.0 to 20%, based on the weight of the softening agent of a water-soluble, organic nonionic surfactant inert in the reaction of said reaction product and phosphate compound.

23. A textile softened with a softening agent of claim 1.

* * * * *